US007783236B2

(12) United States Patent
Lee et al.

(10) Patent No.: US 7,783,236 B2
(45) Date of Patent: Aug. 24, 2010

(54) DEVELOPING UNIT HAVING DEVELOPER FEEDING PLATE AND IMAGE FORMING APPARATUS HAVING THE SAME

(75) Inventors: Jun-ho Lee, Suwon-si (KR); Dong-hoon Park, Osan-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 179 days.

(21) Appl. No.: 11/964,981

(22) Filed: Dec. 27, 2007

(65) Prior Publication Data

US 2008/0193170 A1 Aug. 14, 2008

(30) Foreign Application Priority Data

Feb. 8, 2007 (KR) ..... 10-2007-0013434

(51) Int. Cl.
*G03G 15/08* (2006.01)

(52) U.S. Cl. ..... 399/281; 399/254

(58) Field of Classification Search ..... 399/119, 399/222, 252, 262, 272, 281, 254
See application file for complete search history.

(56) References Cited

U.S. PATENT DOCUMENTS 6,738,593 B2 * 5/2004 Kawamura et al. ..... 399/281
7,110,708 B2 * 9/2006 Jeon ..... 399/260
2008/0181669 A1 * 7/2008 Kwon ..... 399/222

FOREIGN PATENT DOCUMENTS

| | | |
|---|---|---|
| JP | 2005-215438 | 8/2005 |
| KR | 1996-702633 | 4/1996 |
| KR | 1999-5249 | 2/1999 |
| KR | 2004-64766 | 7/2004 |

OTHER PUBLICATIONS

Machine translation of Gwak (KR 20-1999-0005249, Listed in IDS).*

* cited by examiner

*Primary Examiner*—David M Gray
*Assistant Examiner*—Rodney Bonnette
(74) *Attorney, Agent, or Firm*—Stanzione & Kim, LLP

(57) ABSTRACT

A developing unit includes a developer feeding unit which feeds developer to an image receptor, a casing which supports the developer feeding unit and includes a developer storing part provided in an area to face the developer feeding unit and to store the developer, and a developer feeding plate which is formed with a developer flowing hole through which the developer flows, and is provided to move between the developer storing part and the developer feeding unit.

23 Claims, 11 Drawing Sheets

DEVELOPING UNIT HAVING DEVELOPER FEEDING PLATE AND IMAGE FORMING APPARATUS HAVING THE SAME

CROSS-REFERENCE TO RELATED APPLICATIONS

This application claims priority from Korean Patent Application No. 10-2007-0013434, filed on Feb. 8, 2007 in the Korean Intellectual Property Office, the disclosure of which is incorporated herein in its entirety by reference.

BACKGROUND OF THE INVENTION

1. Field of the Invention

The present general inventive concept relates to a developing unit and an image forming apparatus having the same, and more particularly, to a developing unit having an improved developer feeding configuration and an image forming apparatus having the same.

2. Description of the Related Art

In general, a color image forming apparatus scans light onto an image receptor having a predetermined electric potential to form an electrostatic latent image, spreads a color developer on the electrostatic latent image and transfers and fuses the same on a printing medium to form a color image. The color of the developer used for the color image forming apparatus generally includes yellow, magenta, cyan, and black.

The color image forming apparatus is classified into a single-path type and a multi-path type. The multi-path type image forming apparatus employs a single exposure part, a single electrifying unit and four developing units for developing each of the colors. A color image is formed by rotating the image receptor four times. Accordingly, the multi-path type image forming apparatus printing time is four times longer than the single-path type image forming apparatus. On the other hand, the multi-path type image forming apparatus has the advantage of having a simple configuration, and a lower manufacturing cost since it employs a single exposure part and a single electrifying unit.

FIG. 1 is a schematic view illustrating a structure of a conventional multi-path type color image forming apparatus 10. As illustrated in FIG. 1, the image forming apparatus 10 includes an image receptor 20 electrified by an electrifying unit (not shown), an exposure part (or light scanning unit) 40 which scans light onto the image receptor 20 to form an electrostatic latent image, and a developing device 30 which supplies developer to the electrostatic latent image of the image receptor 20 to form a visible image thereon.

Here, the developing device 30 includes plural developing units 30K, 30Y, 30M and 30C, corresponding to colors of the developer stored therein, here for example, the colors of cyan, magenta, yellow, and black. Also, each of the developing units includes a casing 31, a developer feeding unit 32 which is disposed to face the image receptor 20 and spreads developer on the electrostatic latent image, a supplying part 33 which supplies the developer to the developer feeding unit 32, and a developer feeding part 35 which feeds the developer accommodated inside the casing 31 to the supplying part 32.

As illustrated in FIG. 2, the conventional developer feeding part 35 includes a plurality of agitators 35*a*, 35*b*, 35*c*, and 35*d* disposed to be parallel with each other for feeding the developer. That is, the developer is sequentially fed from the agitator 35*a* furthest from the developer feeding unit 32 to the agitator 35*d* closest to the developer feeding unit 32. However, in the conventional developer feeding part 35 with this configuration, the plurality of agitators 35*a*, 35*b*, 35*c*, and 35*d* should be rotated in the same direction to feed the developer smoothly, and the rotating speed of the agitator 35 should be increased from agitator 35*a* to agitator 35*d*.

Accordingly, there has been a problem that a power transmission part for transmitting a driving force has a complicated configuration, and in order to rotate the plurality of agitators at optimum speed, the driving part is apt to be overloaded.

In addition, these problems may become more aggravated when it is desired to minimize the size of the image forming apparatus by reducing the height of the developing unit casing, since the number of agitators for feeding the developer should be increased.

Furthermore, if the number of the agitators increases, the time during which the developer contacts with the agitators increases. When this contacting time with the agitators increases, the stress applied to the developer by frictional forces increases, thereby deforming the developer and thus the printing quality deteriorates.

SUMMARY OF THE INVENTION

Accordingly, the present general inventive concept provides a developing unit having a simple driving configuration capable of enhancing a feeding efficiency of a developer, and an image forming apparatus including the same.

Another aspect of the present general inventive concept provides a developing unit which does overly stress developer when feeding the developer and an image forming apparatus including the same.

Additional aspects of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developing unit, including a developer feeding unit to feed a developer to an image receptor, a casing which supports the developer feeding unit and includes a developer storing part provided in an area to face the developer feeding unit and to store the developer, and a developer feeding plate which is formed with a developer flowing hole through which the developer flows, and is provided to move between the developer storing part and the developer feeding unit.

The developing unit may include a feeding force transmitting part which is coupled to a driving part and to apply a feeding force to the developer feeding plate to move the developer feeding plate between the developer storing part and the developer feeding unit.

The feeding force transmitting part may be provided as a crankshaft.

The crankshaft may include a bending pressing part which is bending-formed by a predetermined length.

A moving distance of the developer feeding plate may correspond to a length in which the bending pressing part is bent with respect to the crankshaft.

A height of the casing may be twice as long as a length in which the bending pressing part is bent with respect to the crankshaft.

The developer feeding plate may further include a pressing rib which is provided to contact with the bending pressing part and is pressed by the bending pressing part, and enables the developer feeding plate to move between the developer feeding unit and the developer storing part when the crankshaft rotates.

The feeding force transmitting part may include a pinion which is coupled to the driving part, and a rack which is provided in the developer feeding plate.

The developing unit may further include a supplying part which is provided between the developer feeding unit and the feeding force transmitting part and to supply the developer fed by the developer feeding plate to the developer feeding unit.

The developing unit further includes an elastic member which is provided between the casing and the developer feeding plate and to apply an elastic force to the developer feeding plate to return the developer feeding plate having moved from the developer feeding unit to the developer storing part to the developer feeding unit.

A returning speed of the developer feeding plate from the developer storing part to the developer feeding unit by the elastic member may be higher than a moving speed of the developer feeding plate from the developer feeding unit to the developer storing part.

Plural developer feeding plate may be provided

The developer flowing hole may have a rounded shape or a polygonal shape.

Plural developer flowing holes may be provided.

The foregoing and/or other aspects and utilities of the present general inventive concept can also be achieved by providing an image forming apparatus, including a paper feeding part to feed a printing medium, a developing unit, an image receptor to spread developer supplied from the developing unit on the printing medium, an exposure part to expose the image receptor, and a transfer part to transfer the developer of the image receptor to the printing medium.

The image forming apparatus may further include a driving part to generate a driving force and a power transmission part to transmit the driving force of the driving part to the feeding force transmitting part.

The foregoing and/or other aspects and utilities of the present general inventive concept may also be achieved by providing a developing unit usable with an image forming apparatus, including a developer chamber to store developer, a developer roller attached at an opening of the developer chamber to transmit the developer to an image receptor of the image forming apparatus, and a perforated plate formed with at least one developer flowing hole and movably positioned within the developer chamber to transmit developer to the developer roller.

The foregoing and/or other aspects and utilities of the present general inventive concept may also be achieved by a method of providing developer to an image receptor of an image forming apparatus, the method comprising reciprocating a perforated plate along a base of a developing cartridge to move developer towards a developing roller, coating the developing roller with developer moved towards the developing roller by the reciprocating operation, and applying developer from the developing roller to the image receptor in accordance with a latent electrostatic image on the image receptor.

The foregoing and/or other aspects and utilities of the present general inventive concept may also be achieved by a developing unit usable with an image forming apparatus, the developing unit including a casing to store a developer, and a developer feeding plate disposed on a plane in the casing to reciprocate along the plane to move the developer in a direction along the plane.

The foregoing and/or other aspects and utilities of the present general inventive concept may also be achieved by a developing unit usable with an image forming apparatus, the developing unit including a casing to store a developer, and a developer feeding plate having a plate main body having thickness and a second thickness and disposed to move the developer according to a difference at the first thickness and second thickness.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
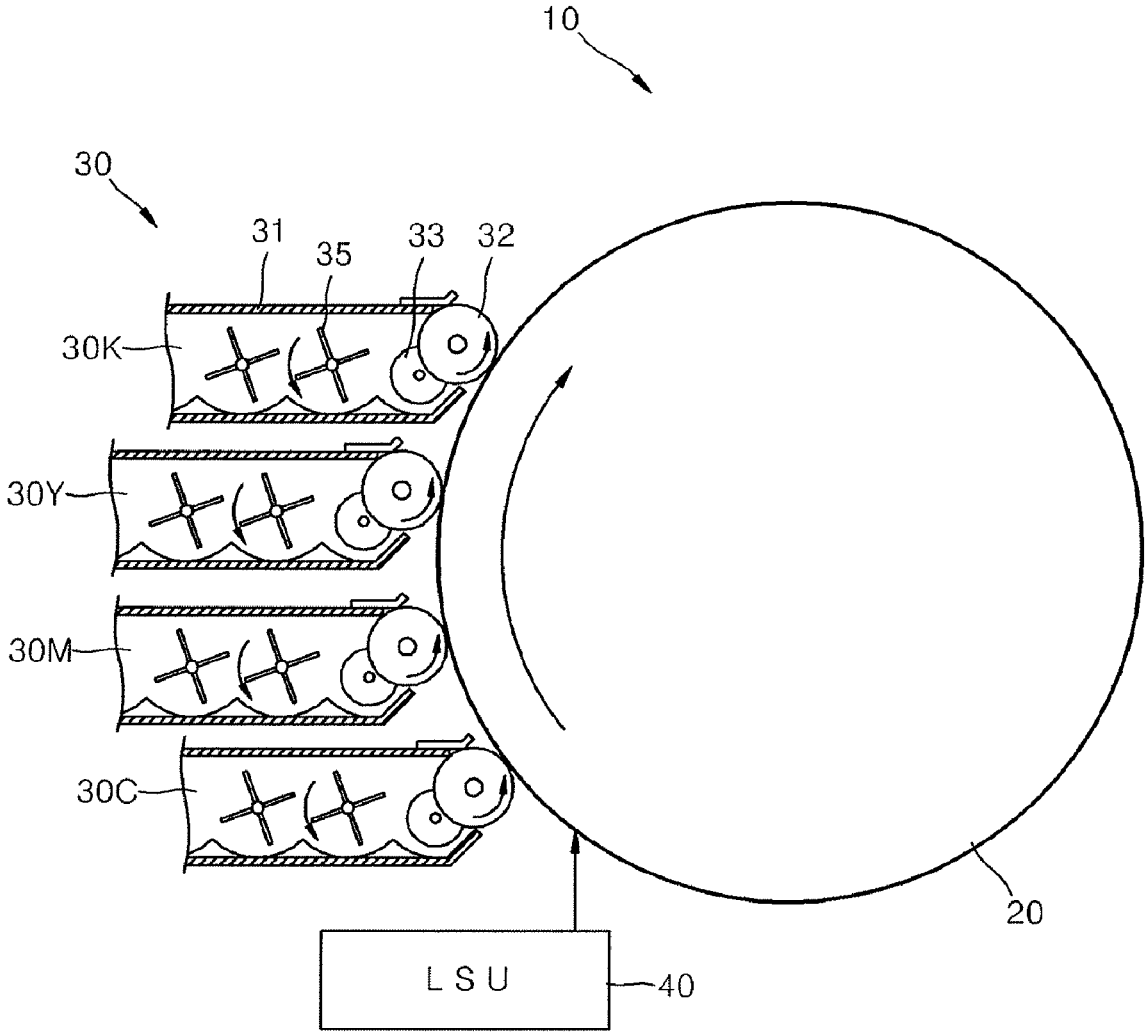
FIG. 1 (CONVENTIONAL ART)
FIG. 1 is a sectional view illustrating a structure of a conventional image forming apparatus.
Figure 2:
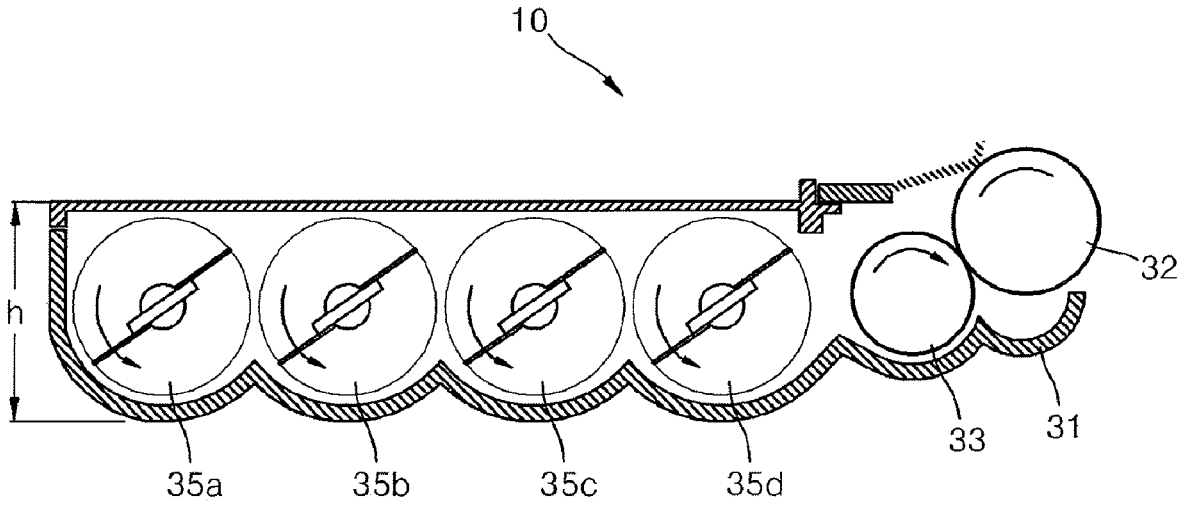
FIG. 2 (CONVENTIONAL ART)
FIG. 2 is a sectional view illustrating a structure of a conventional developing unit.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 3:
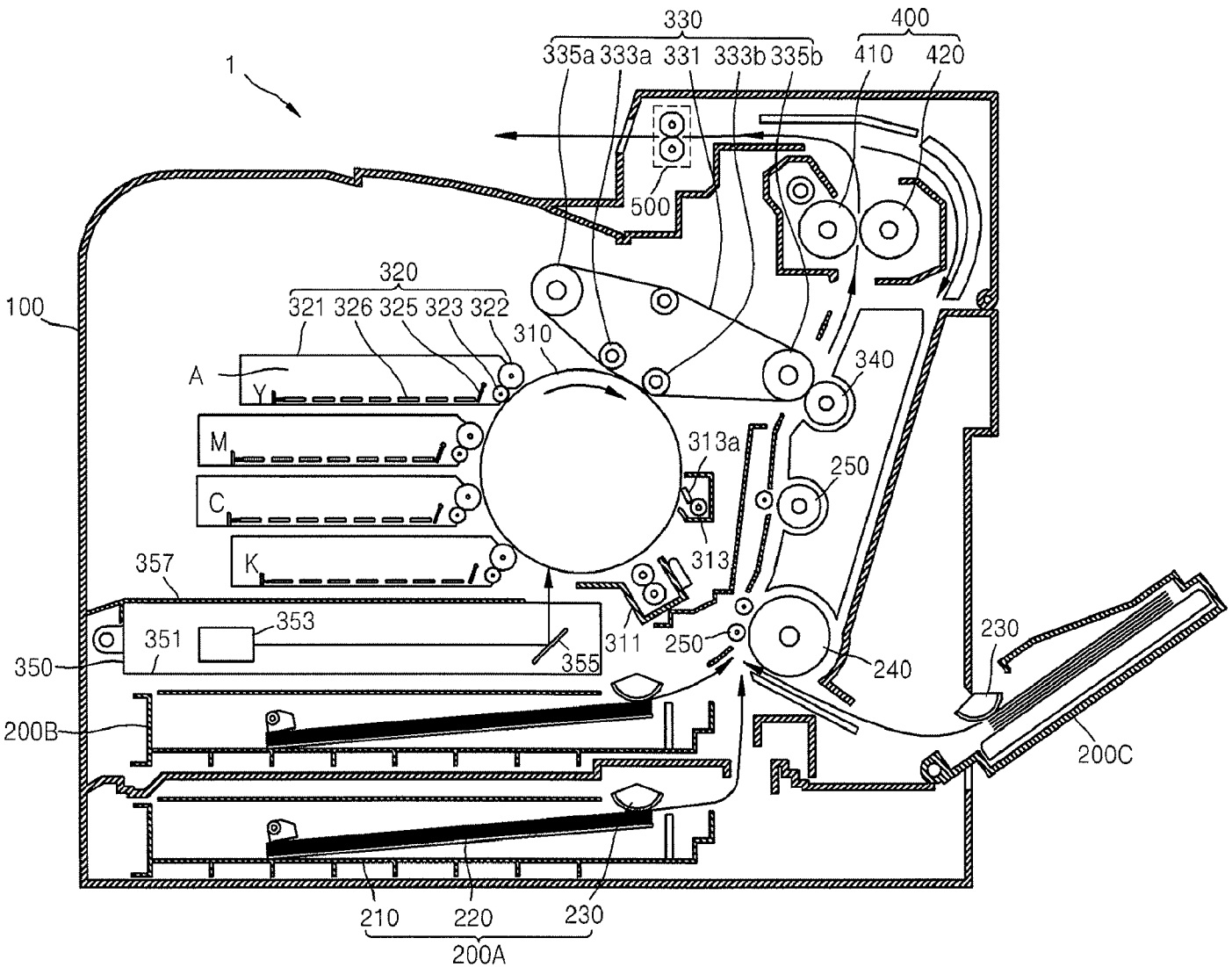
FIG. 3 is a sectional view illustrating a structure of an image forming apparatus according to an exemplary embodiment of the present general inventive concept.
Figure 4:
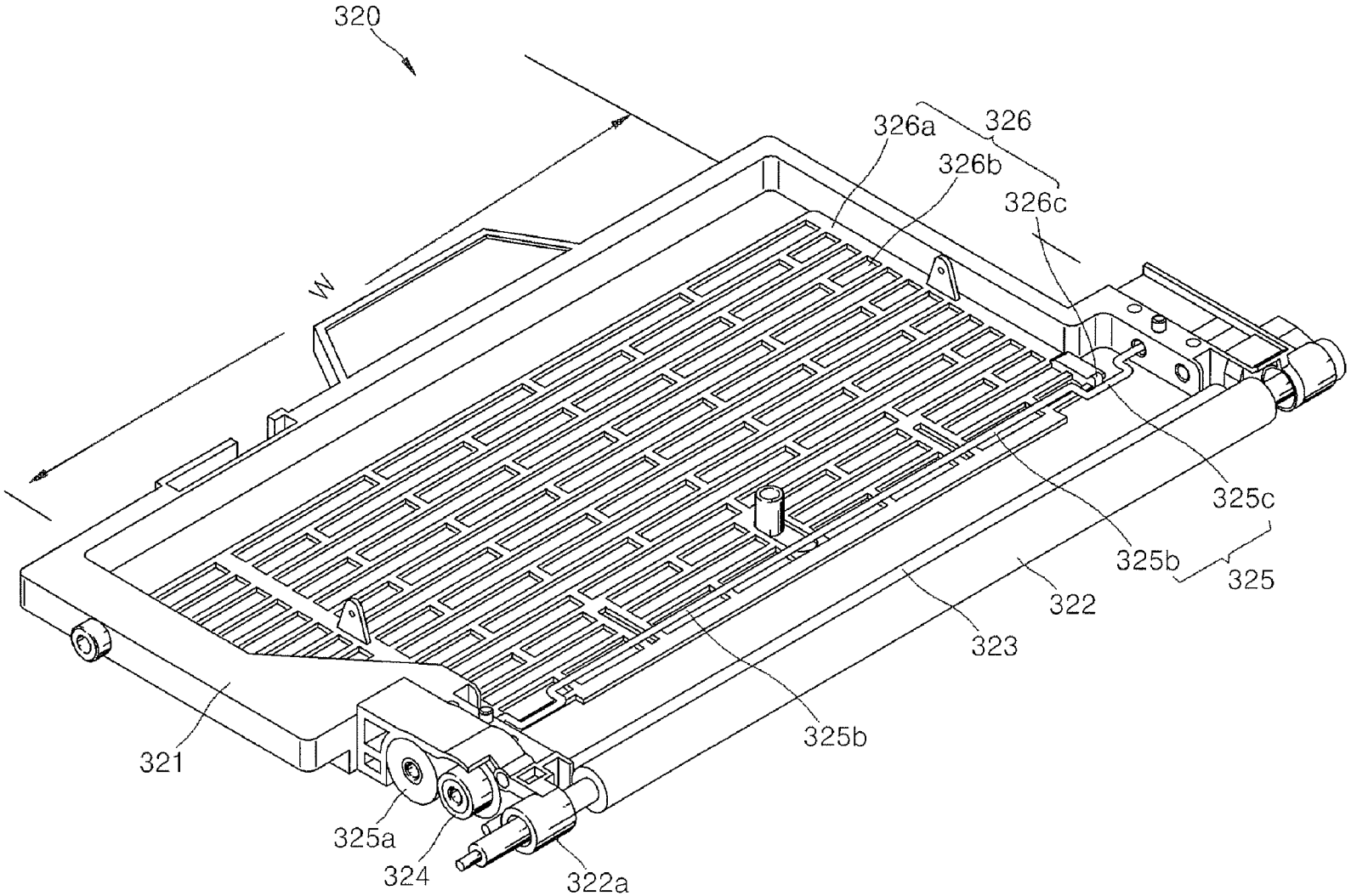
FIG. 4 is a perspective view illustrating a structure of a developing unit according to an exemplary embodiment of the present general inventive concept.

FIG. 3 is a sectional view illustrating a structure of an example of an image forming apparatus 1, and FIG. 4 is a perspective view illustrating a structure of an example developing unit 320. As illustrated in FIGS. 3 and 4, the image forming apparatus 1 includes a main body 100, a paper feeding part 200 (200A, 210, 220, and 230) which is provided on one side of the main body 100 to load a printing medium, an image forming part 300(310, 320, 330, and 340) which spreads developer on a printing medium fed from the paper feeding part 200 to form an image thereon, a fusing part 400 which fuses the developer onto the printing medium by heat and pressure, and a discharging part 500 which discharges the printed printing medium.

The paper feeding part 200is loaded with a printing medium to feed the printing medium to the image forming part if a printing signal is applied.

The paper feeding part 200 may include plural elements of similar structure according to the size and the characteristic of the loaded printing medium. To assist refilling the printing medium, the paper feeding part 200 according to this exemplary embodiment includes a first paper feeding part 200A and a second paper feeding part 200B which are detachably coupled to the main body 100, and a third paper feeding part 200C which is rotatably coupled to the main body 100. Each of the paper feeding parts 200A, 200B, and 200C includes a cassette main body 210 which is coupled to the main body 100, a knock-up plate 220 on which a printing medium is loaded, and a pick-up roller 230 which picks up the printing medium out of the knock-up plate 220 if the printing signal is applied. Also, the paper feeding part 200 may further include a feeding roller 240 to feed the printing medium picked up by the pick-up roller 230 to the image forming part 300, and a registering roller 250 which registers a leading edge of the printing medium. The detailed description of the configuration of the paper feeding part will be omitted as it may be the same as a conventional paper feeding part.

The image forming part 300 includes an image receptor 310 on which developer is spread, a developing device including plural developing units 320 to supply the developer to the image receptor 310, a mid-transfer part 330 to which the developer on the image receptor 310 is initially transferred, a transfer part 340 to transfer the developer of the mid-transfer part 330 to the printing medium, and an exposure part 350 to scan light onto the image receptor 310 to form an image thereon.

Developer is transferred from the image receptor 310 to the mid-transfer part 330. Here, the image receptor 310 includes a photoconductive material layer coated (e.g., using a deposition method) on an external circumference surface of a cylindrical metal drum. The photoconductive material layer responds to the light and an electrostatic latent image corresponding to the image data is formed thereon if it is exposed to the exposure part 350.

Further provided on one side of the image receptor 310 are an electrifying part 311 which electrifies a surface of the image receptor 310 to a predetermined electric potential, a charge erasing part (not shown) which transfers the developer to the mid-transfer part 330 and keeps the electric potential on the surface of the image receptor 310 uniform, and a cleaning part 313 which cleans waste developer not having been transferred to the mid-transfer part 330 and remaining on the surface of the image receptor 310. The cleaning part 313 includes a cleaning blade 313*a*.

The developing device is provided on another side of the image receptor 310 and spreads developer onto the electrostatic latent image of the image receptor 310 to form a visible image thereon. The developing device includes plural developing units 320 each corresponding to respective colors of yellow, magenta, cyan, and black of the developer. The developing unit 320 according to this exemplary embodiment includes a casing (or housing) 321, a developer feeding unit 322 which is provided to be in contact or out of contact with the image receptor 310 and spreads developer on the image receptor 310, a supplying part 323 to supply developer to the developer feeding unit 322, a developer feeding plate 326 which reciprocally moves inside the casing 321 and to feed the developer toward the supplying part 323, a power transmission part 324 which to transmit a driving force of the main body 100 to the developing unit 320, and a feeding force transmitting part 325 which is supplied with the driving force from the power transmission part 324 and to move the developer feeding plate 326.

The casing 321 is detachably provided within the main body 100 and stores developer therein. The casing 321 supports the developer feeding unit 322 so that the developer feeding unit 322 can develop the developer in contact or out of contact with the photoreceptor 310. The casing 321 stores the developer in a developer storing part "A" provided to face the developer feeding unit 322.

The developer feeding unit 322 spreads the developer supplied from the supplying part 323 on the electrostatic latent image of the image receptor 310. As illustrated in FIG. 4, the developer feeding unit 322 includes a power transmission part coupling part 322*a* which is coupled to the power transmission part 324. The developer feeding unit 322 rotates in engagement with the driving of the power transmission part coupling part 322*a* and spreads the developer on the image receptor 310. Here, a developing voltage is applied to the developer feeding unit 322 from a power supplying part (not shown) so as to assist the transfer of the developer attached to its surface to the image receptor 310.

The developing voltage may be higher than the voltage of those portions of the surface of the image receptor 310 having an electrifying voltage remaining from application from the electrifying part 311, and may be lower than the voltage on those portions of the surface of the image receptor 310 having the electrostatic latent image due to exposure by the exposure part 350. Accordingly, the developer on the surface of the developer feeding unit 322 is attached to the electrostatic latent image of the image receptor 310 by the potential difference.

A developer regulator (not shown) is provided on one side of the developer feeding unit 322 to apply a tangential pressure to the developer feeding unit 322 so that the developer supplied from the supplying part 323 is spread on the surface of the developer feeding unit 322 with a uniform thickness. The developer regulating member (not shown) may regulate the thickness of the developer layer spread on the developer feeding unit 322 through an angle which a regulating blade makes with the surface of the developer feeding unit 322 at a point of contact.

The supplying part 323 rotates and supplies the developer supplied from the developer storing part A by the developer feeding plate 326 to the developer feeding unit 322 if the printing signal is applied. The supplying part 323 in this example is a roller, but may also be a sponge, or a brush for example. The supplying part 323 contacts the developer and generates static electricity to frictionally electrify the developer.

As illustrated in FIGS. 3 and 4, the developer feeding plate 326 is movably provided on a bottom surface of the casing 321 and feeds the developer stored in the developer storing part A toward the supplying part 323. The developer feeding plate 326 includes a plate main body 326*a* which has a predetermined area and moves between the developer storing part A and the supplying part 323, a developer flowing hole 326*b* which is perforated in the plate main body 326*a* and through which the developer fed from the developer storing part A flows, and a pressing rib 326*c* which is provided on one side of the plate main body 326*a* and is pressed by the feeding force transmitting part 325 to move the plate main body 326*a*. Here, the developer feeding plate 326 is disposed lower than a center of the casing 321 in a vertical direction, that is, a center of a line perpendicular to a reciprocating direction of the developer feeding plate 326. The developer feeding plate 326 is disposed closer to the bottom surface than a top surface of the casing 321.

Figure 6A:
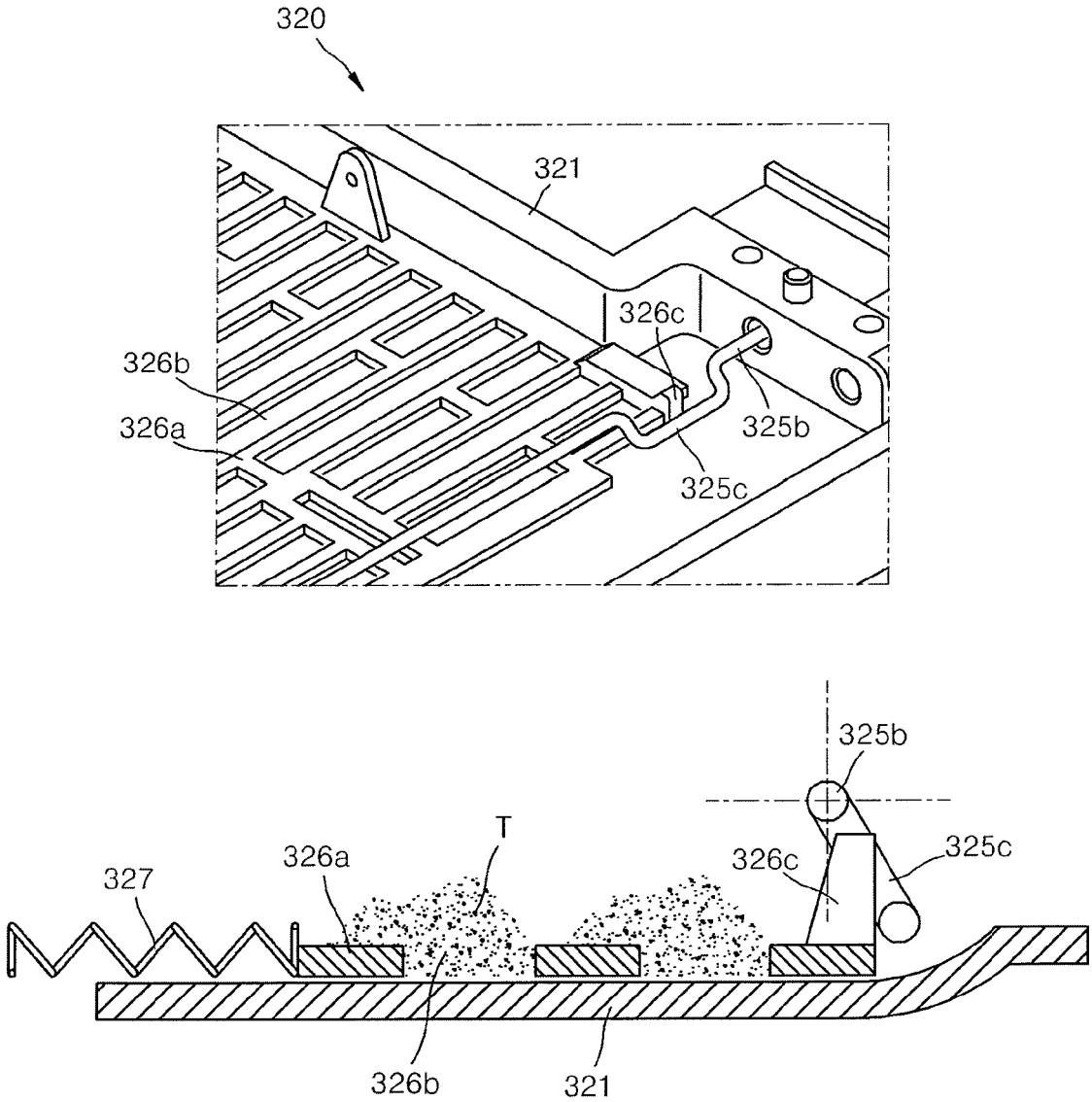
FIGS. 6A through 6C are perspective views and sectional views illustrating operating process of a developing unit according to an exemplary embodiment of the present general inventive concept.
Figure 6B:
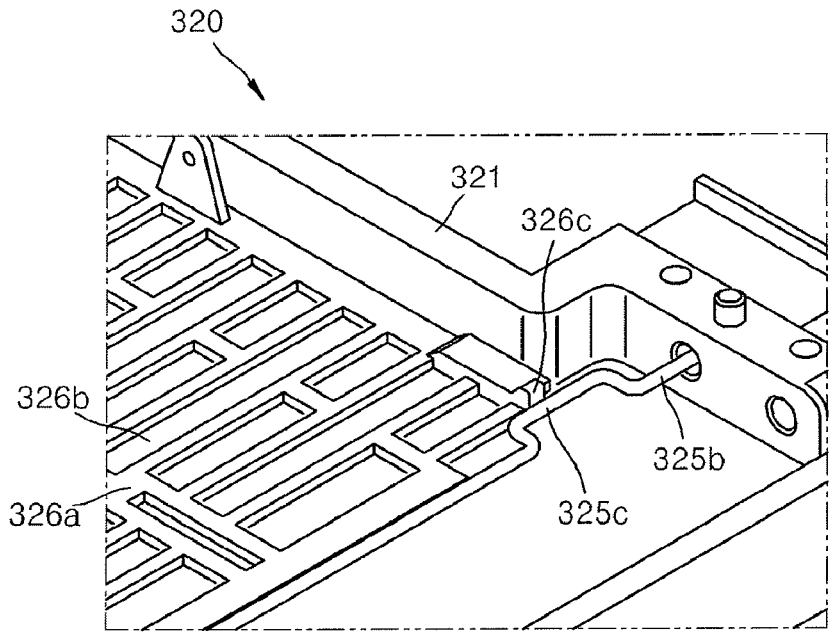
Figure 6B:
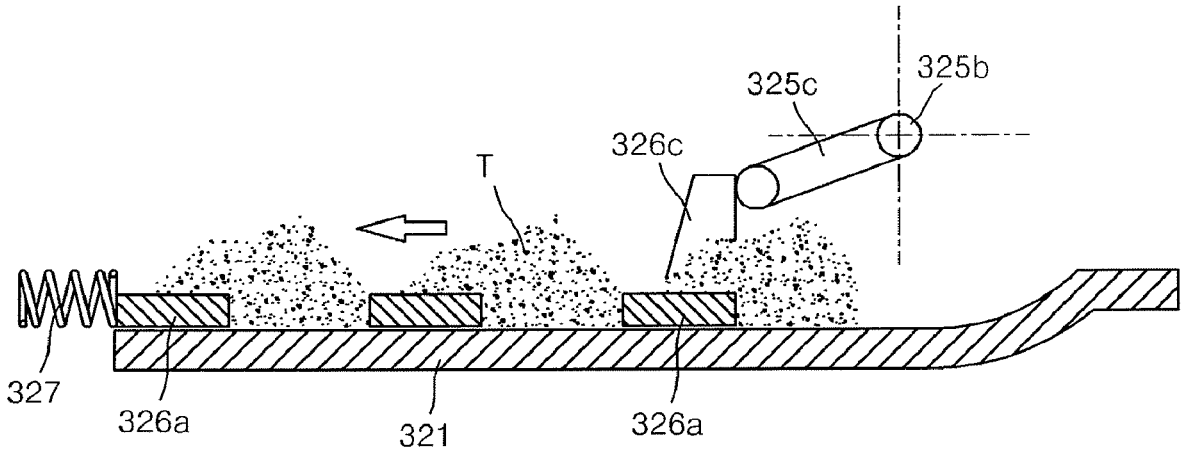
Figure 6C:
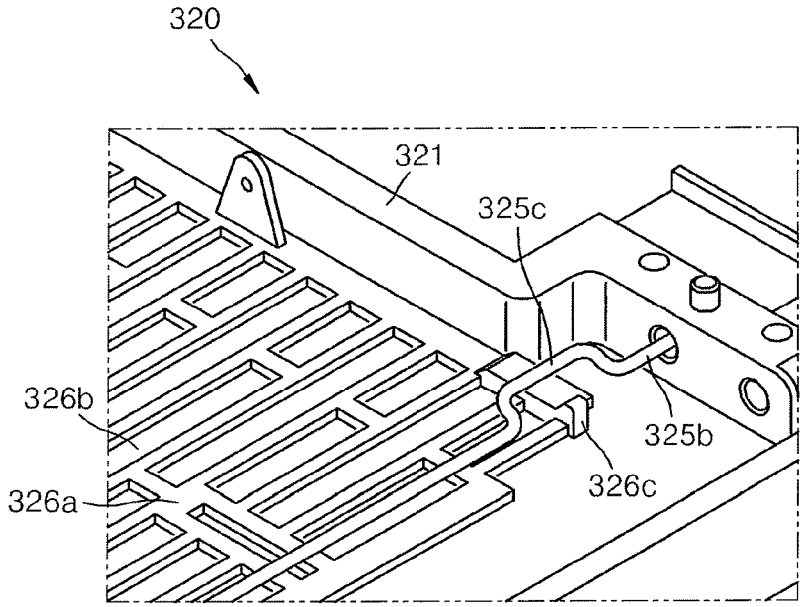
Figure 6C:
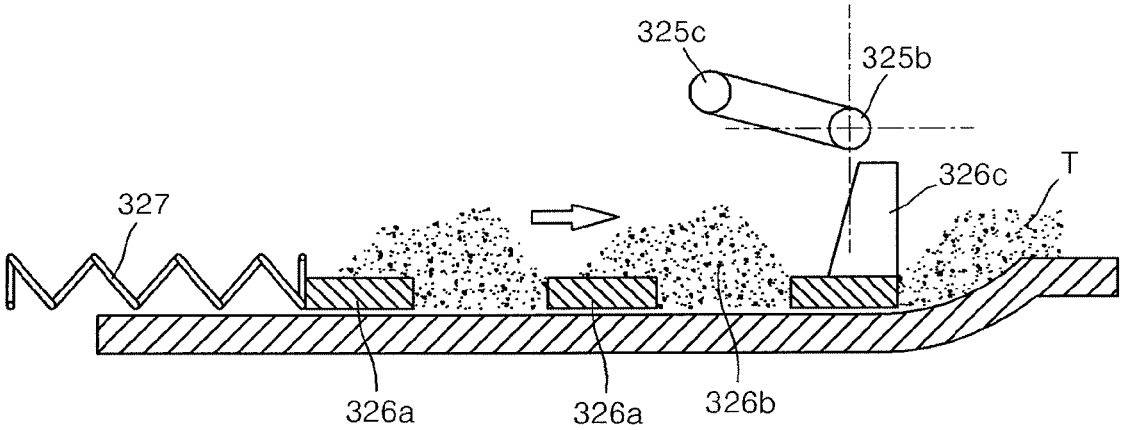

The plate main body 326*a* has a width W corresponding to the bottom surface of the casing 321, and may be provided to be shorter by a predetermined length in comparison with the length L of the bottom surface of the casing 321. As illustrated in FIGS. 6A to 6C, the plate main body 326*a* is provided to move toward the supplying part 323 and the developer storing part A by the feeding force transmitting part 325 and an elastic member 327.

The developer flowing holes 326*b* are perforated throughout the plate main body 326*a* and enable the developer to flow when the plate main body 326*a* moves between the developer storing part A and the supplying part 323. The developer is loaded about the plate main body 326*a* and fed to the supplying part 323 when the plate main body 326*a* moves to the developer storing part A, and is stored on the bottom surface of the casing 321. The developer flows through the developer flowing holes 326*b* when the plate main body 326*a* moves from the supplying part 323 toward the developer storing part A.

The size and shape of the developer flowing holes 326*b* may be designed to have various configurations to assist the movement of the developer to the supplying part 323. For example, the developer flowing holes 326*b* may be a polygonal shape such as a triangular shape and a quadrangular shape, or a round shape. Also, the developer flowing holes 326*b* of this example may be replaced with a single hole 326*b* in plate main body 326*a*. The choice of the amount, size and shape of the developer flowing hole(s) 326*b* may be chosen in consideration of the feeding speed and the feeding amount of the developer feeding plate 326. It has been observed that the amount of the developer fed by one-time reciprocation of the developer feeding plate 326 between the supplying part 323 and the developer storing part A is less when the developer flowing hole 326*b* takes up a large area in the plate main body 326*a*.

Also, the interval between the developer flowing holes 326*b* may be made smaller than or the same as the feeding distance of the developer feeding plate 326.

The plate main body 326*a* may be a lattice having lattice members to define corresponding developer feeding holes 326*b*. The developer feeding plate 320 may have a first plate having a first thickness to correspond to the plate main body 326*a*, and a second plate having a second thickness to correspond to the developer flowing hole 326*b*, so that the developer can move along a direction parallel to a plane on which the first plate and the second plate are disposed, according to a difference of the first thickness and the second thickness in a direction perpendicular to the moving direction of the developer feeding plate 326. As illustrated in FIG. 4, the second thickness of the developer flowing hole 326*b* may be zero, and the difference may be the first thickness of the plate main body 326*a*. It is possible that a plate having the second thickness is formed on the plate main body 326*a* to correspond to the developer flowing hole 326*b*.

The pressing rib 326*c* is provided adjacent to the feeding force transmitting part 325. The pressing rib 326*c* is pressed to enable the plate main body 326*a* to move between the developer storing part A and the supplying part 323 when the feeding force transmitting part 325 rotates. As illustrated in FIGS. 6A through 6C, the pressing rib 326*c* protrudes from the plate main body 326*a* to be pressed by bending part 325*c* of the feeding force transmitting part 325. The pressing rib 326*c* may be provided to have a height high enough to be in contact and pressed by the bending part 325*c*.

The power transmission part 324 is provided on one side of the casing 321 and is assembled with the driving part (not shown) of the main body 100 to transmit the driving force when the casing 321 is mounted to the main body 100. The power transmission part 324 transmits the driving force to the developer feeding unit 322 and the feeding force transmitting part 325. As illustrated in FIG. 4, the power transmission part 324 may be a gear. In this example, the power transmission part 324 transmits a rotational force to the developer feeding unit 322 and the feeding force transmitting part 325. In an alternative example, the power transmission part 324 may be provided as a belt in place of the gear.

The feeding force transmitting part 325 converts the rotational movement transmitted from the power transmission part 324 into a linear movement of the developer feeding plate 326. The feeding force transmitting part 325 includes a driving force transmitting part 325*a* which is coupled to the power transmission part 324 and transmits the driving force, a rotational shaft 325*b* which is coupled to the driving force transmitting part 325*a* and rotates, and a bending part 325*c* which is bending-formed by a predetermined length from the rotational shaft 325*b* and presses the plate main body 326*a*. The feeding force transmitting part 325 according to the exemplary embodiment of the present general inventive concept is provided as a crankshaft.

As illustrated in FIG. 4, the driving force transmitting part 325*a* is provided on one side of the power transmission part 324 and receives driving force from the power transmission part 324. The driving force transmitting part 325*a* is provided to engage the power transmission part 324. Here, the power transmission part 324 is provided as a gear, and the driving force transmitting part 325*a* is also provided as a gear. The driving force transmitting part 325*a* determines the rotating speed of the rotational shaft 325*b* and should be designed in consideration of the desired feeding speed of the developer feeding plate 326. That is, rotation of rotational shaft 325*b* may be chosen in consideration of the amount of the developer fed when the developer feeding plate 326 reciprocates one time as the feeding speed of the developer feeding plate 326 is a function of the rotating speed of the driving force transmitting part 325*a*.

Figure 5A:
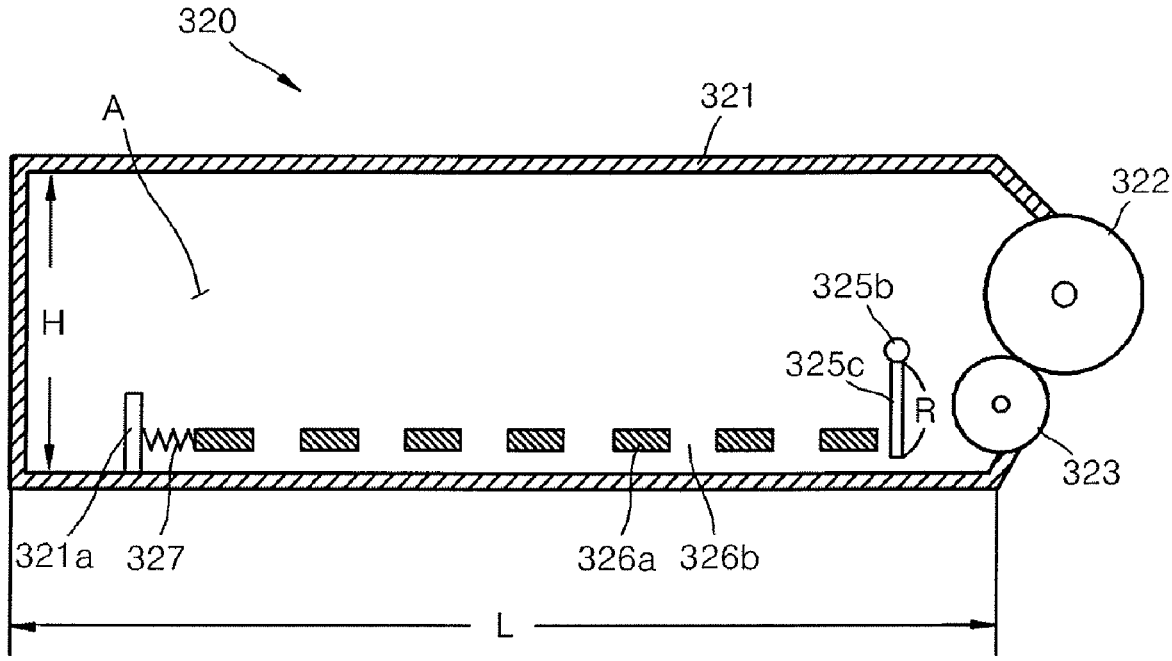
FIGS. 5A through 5D are sectional views illustrating various exemplary embodiments of a developing unit according to embodiments of the present general inventive concept.

The rotational shaft 325*b* is provided between the supplying part 323 and the developer feeding plate 326 to rotate along with the rotation of the driving force transmitting part 325*a*. As illustrated in FIG. 5A, the rotational shaft 325*b* may be provided in a height where the bending part 325*c* does not reach the bottom surface of the casing 321 when the bending part 325*c* is disposed perpendicularly to the bottom surface of the casing 321.

The bending part 325*c* presses the pressing rib 326*c* of the plate main body 326*a* and converts the rotational movement of the rotational shaft 325*b* into the linear movement of the developer feeding plate 326. The bending part 325*c* is bent to extend a predetermined length from the rotational shaft 325*b* to press the pressing rib 326*c*. Here, when the bending part 325*c* presses the pressing rib 326*c* during a rotation of the rotational shaft 325*b*, the plate main body 326*a* moves toward the developer storing part A. The moving speed at which the plate main body 326*a* moves from the supplying part 323 to the developer storing part A is a function of the rotating speed of the rotational shaft 325*b*.

Meanwhile, if the bending part 325*c* is moves away from the pressing rib 326*c* during the rotation of the rotational shaft 325*b*, the plate main body 326*a* moves toward the supplying part 323 due to an elastic force of an elastic member 327 to be described later.

The bending length R of the bending part 325*c* determines the moving distance of the developer feeding plate 326. The amount of the developer which is fed may increase with the increase of the bending length R since the distance which the developer feeding plate 326 moves toward the developer storing part A also increases. However, there may be a disadvantage in making the bending length R too long in that the height H of the casing 321 may need to increase to accommodate the larger rotating radius of the bending part 325*c*. Accordingly, the bending length R may be properly designed in consideration of the height H of the casing 321 and the distance between the supplying part 323 and the developer storing part A.

The bending part 325*c* may be provided plurally along the rotational shaft 325*b*. Also, the bending part 325*c* may be provided in a central portion and/or opposite end portions of the rotational shaft 325*b*.

The elastic member 327 is provided between the casing 321 and the developer feeding plate 326 and applies an elastic force to the plate main body 326*a* so that the plate main body 326*a* returns toward the supplying part 323 after having moved toward the developer storing part A. The elastic member 327 may be provided as a coil spring or as a plate spring, or as another elastic structure.

Figure 5B:
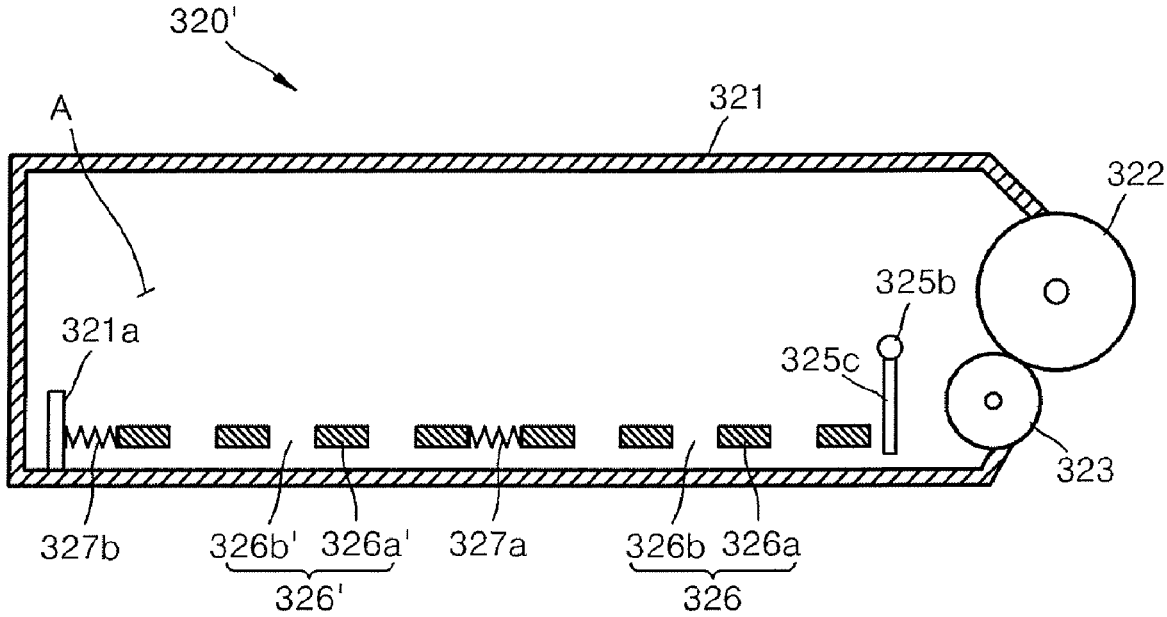

In this example, the elastic member 327 is provided as a coil spring, and is provided in a side of the developer storing part A as illustrated in FIG. 5A, or may be provided within casing 321 at a location opposite from the supplying part 323 as illustrated in FIG. 5B. In FIG. 5A, the elastic member 327 is provided as a coil spring which is compressed by the action of the feeding force transmitting part 325 and moves the developer feeding plate towards the supplying part 323 when the coil spring expands toward it restored configuration. That is, the coil spring is pressed when the plate main body 326*a* moves toward the developer storing part A by the pressure of the bending part 325*c*, and is elastically expanded to enable the plate main body 326*a* to return toward the supplying part 323 with the release of the pressing force of the bending part 325*c* to the plate main body 326*a*.

Figure 5C:
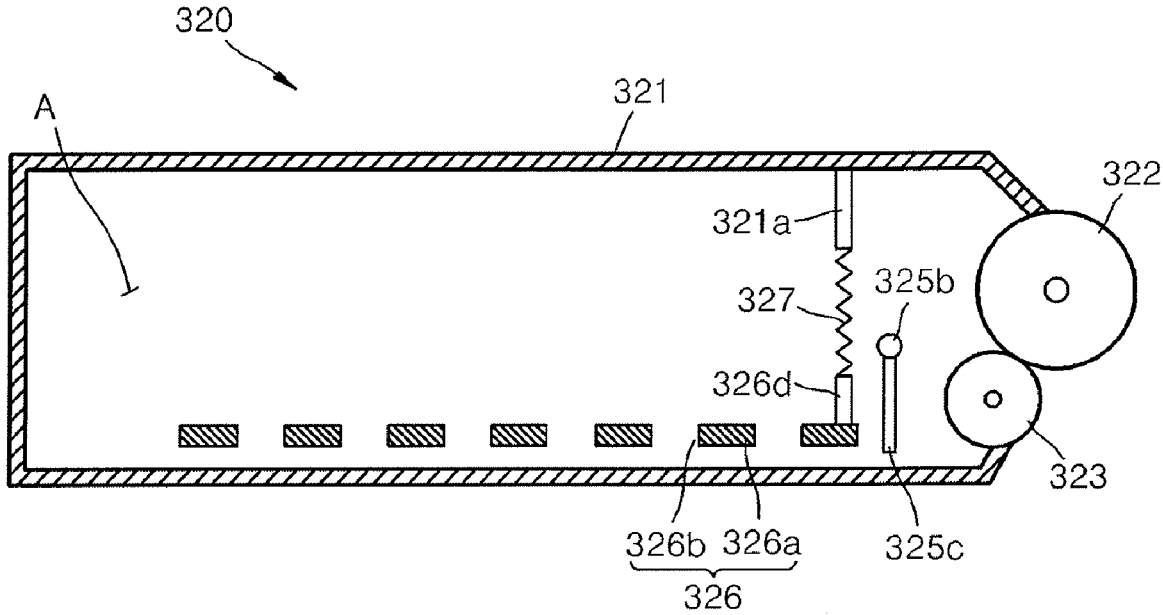

Alternatively, as illustrated in FIG. 5C, the elastic member 327 may be provided as a coil spring which is expanded by the action of the feeding force transmitting part 325 and moves the developer feeding plate 326 towards the supplying part 323 via its elastic contraction. That is, if the plate main body 326*a* moves toward the developer storing part A by the pressing force of the bending part 325*c*, the coil spring is expanded from an initial length, and if the pressing force of the bending part 325*c* is released, the coil spring contracts to enable the plate main body 326*a* to return toward the supplying part 323.

One end part of the elastic member 327 may be directly coupled to the casing 321 according to the size and the shape of the plate main body 326*a* or, as in the example of FIG. 5C, coupled to the casing 321 via an elastic member coupling part 321 a protruding from the casing 321. Also, the opposite end part of the elastic member 327 may be directly coupled to the plate main body 326*a*, or, as in the example of FIG. 5C, coupled to the casing 321 via an elastic member coupling part 326*d* protruding from the plate main body 326*b*.

The elastic member 327 may be provided so that the returning speed of the plate main body 326*a* by the elastic force is greater than the feeding speed by the pressing force of the bending part 325*c*. Accordingly, the developer in the developer storing part A can be fed to the supplying part 323 in a state of being loaded on the plate main body 326*a*. The elastic coefficient, the thickness, and the size of the elastic member 327 may be chosen in consideration of the rotating speed of the rotational shaft 325*b*.

As illustrated in FIG. 5B, a developing unit 320' according to another exemplary embodiment includes two developer feeding plates 326 and 326'. The two developer feeding plates 326 and 326' are coupled to each other by the elastic member 327*a*, and are pressed by pressing of the bending part 325*c*. When the height H of the casing 321 is low and the length L of the casing 321 is long, it has been found that using a plurality of developer feeding plates 326 and 326' coupled to each other as in this exemplary embodiment is preferable, but not necessary.

Figure 5D:
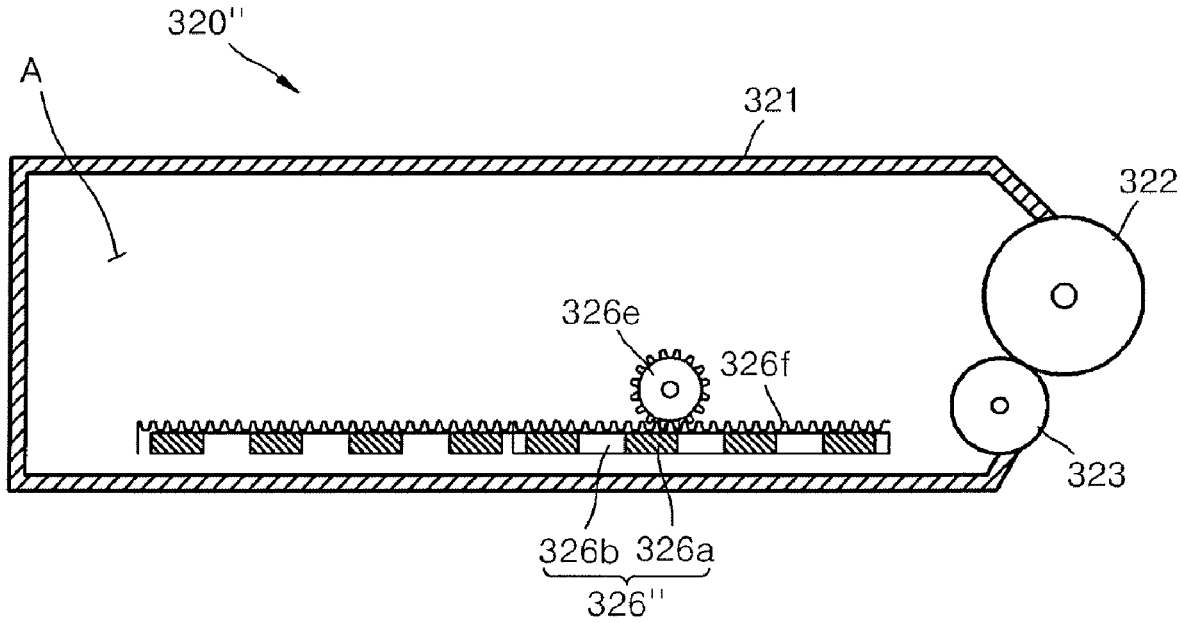

As illustrated in FIG. 5D, in a developing unit 320" according to another exemplary embodiment includes a feeding force transmitting part 325 having a pinion 326*e* and a rack 326*f*. The pinion 326*e* receives a driving force from the power transmission part 324 to rotate in forward and reverse directions. The power transmission part 324 and the pinion 326*e* may be engaged using a belt (not shown) to transmit the driving force. The pinion 326*e* and rack 326*f* should be located to secure a desired feeding distance of the developer feeding plate 326.

The rack 326*f* is provided along a lengthwise direction of opposite end parts of the plate main body 326*a* and in response to the rotation of the pinion 326*e* in forward and reverse directions, moves to and from the supplying part 323 and the developer storing part A.

The developing unit 320" according to this exemplary embodiment has an advantage of better control of the moving distance of the plate main body 326*a* which is in accordance to the rotational driving of the pinion 326*e*. However, this example has a more complicated configuration due to the use of a belt with the power transmission part 324 for driving the pinion 326*e*.

Developer forming a visible image on the surface of the image receptor 310 is first transferred to the mid-transfer part 330. As illustrated in FIG. 3, the mid-transfer part 330 includes a mid-transfer belt 331 which contacts with the image receptor 310 and rotates, a mid-transfer roller 333*a* which is provided on the rear surface of the mid-transfer belt 331 to face the image receptor 310 and applies a transfer voltage to the mid-transfer belt 331, a supporting roller 333*b* which supports the mid-transfer belt 331 toward the image receptor 310, and driving rollers 335*a* and 335*b* which drive the mid-transfer belt 331. The mid-transfer belt 331 is generally provided as an image transfer belt (ITB).

The developer first transferred onto the surface of the mid-transfer belt 331 is then transferred to the printing medium by transfer part 340. The transfer part 340 may be embodied as a transfer roller (as illustrated) provided to face the mid-transfer belt 331 with the printing medium fed from the paper feeding part 200 interposed therebetween. The transfer part 340 applies a transfer voltage to a rear surface of the printing medium to transfer the developer on the surface of the mid-transfer belt 331 to the printing medium.

The exposure part 350 scans the light onto the surface of image receptor 310 to form an electrostatic latent image corresponding to the image data. The exposure part 350 includes a casing (or housing) 351, a light source part (not shown), a polygon mirror assembly 353 which scans the light generated in the light source part (not shown) toward a sub-scanning direction of the image receptor 310, and a reflection mirror 355 which reflects the light scanned in the polygon mirror assembly 353 toward the image receptor 310. Also, the exposure part 350 includes a cleaning shutter 357 which periodically cleans a light scanning window (not shown) of the casing 351.

The fusing part 400 fuses the developer transferred to the surface of the printing medium by heat and pressure. The fusing part 400 may include a heating roller 410 which applies heat to the printing medium, and a pressing roller 420 which is provided to face the heating roller 410 and applies pressure to the printing medium. Also, the fusing part 400 may include a pressing member (not shown) which presses the pressing roller 420 toward the heating roller 410.

The discharging part 500 discharges the printing medium on which an image is formed to the outside. The discharging part 500 includes a discharging roller which discharges the printed printing medium.

Hereinafter, an example of operating the image forming apparatus 100 with this configuration will be described by referring to FIGS. 3 through 6C.

First, when the printing signal is applied, the electrifying part 311 applies voltage to the image receptor 310 to uniformly electrify the surface of the image receptor 310. The exposure part 350 scans light onto the image receptor 310 to form an electrostatic latent image corresponding to the color corresponding to the image data.

As illustrated in FIG. 6A, in the developing unit 320, the rotational shaft 325*b* rotates and the bending part 325*c* presses the pressing rib 326*c*. Accordingly, the plate main body 326*a* moves toward the developer storing part A at a moving speed corresponding to the rotating speed of the rotational shaft 325*b*. At this time, the elastic member 327 is pressed as much as the moving distance of the plate main body 326*a*. The developer T loaded on the plate main body 326*a* is loaded on the bottom surface of the casing 321 through the developer flowing hole 326*b* according to the movement of the plate main body 326*a* as illustrated in FIG. 6B.

If the rotation of the rotational shaft 325*b* continues, the plate main body 326*a* is moved to the developer storing part A and the developer T is loaded on an upper surface of the plate main body 326*a*. If the contact of the bending part 325*c* to the pressing rib 326*c* is released by the continued rotation of the rotational shaft 325*b*, the elastic member 327 elastically returns and applies an elastic force to the plate main body 326*a* as illustrated in FIG. 6C. In this example, the plate main body 326*a* returns to the supplying part 323 at a higher speed than the feeding speed of the plate main body 326*a* from the supplying part 323 to the developer storing part A. At this time, the developer T loaded on the upper surface of the plate main body 326*a* is fed to the supplying part 323 along with the return of the plate main body 326*a*.

Furthermore, when the bending part 325*c* again presses against the pressing rib due to the continued rotation of the rotational shaft 325*b* and the plate main body 326*a* moves accordingly, the developer is not drawn with the plate main body 326*a* but is loaded on the bottom surface of the casing 321 through the developer flowing hole 326*b* since the speed of the plate main body 326*a* is lower than the returning speed.

The developer loaded on the bottom of the casing 321 through the developer flowing holes 326*b* attaches to the surface of the supplying part 323 to develop the developer on the electrostatic latent image of the image receptor 310. The developer spread on the image receptor 310 is transferred to the printing medium through the mid-transfer part 330 and the transfer part 340. The developer transferred to the printing medium is fused to the printing medium by heat and pressure applied by the fusing part 400. The printing paper on which the image is formed is discharged to the outside through the discharging part 500.

As described above, a developing unit feeds developer by a reciprocally moving developer feeding plate. The power transmission part may transmit a driving force to a few structures, e.g., only to the developer feeding unit, the supplying part, and the feeding force transmitting part, thereby obtaining a simple configuration, and reducing overload of the driving part. Also, the configuration of the driving part can be kept simple, thereby reducing noise and vibration in comparison with the conventional developing unit.

Also, since the developer is fed in a state of being loaded on the developer feeding plate, the developer is fed without receiving excessive stress. Accordingly, the deformation of the developer such as separation from an external additive is reduced, thereby improving a printing quality.

In addition, since a planar developer feeding plate is used without using an agitator taking up a large amount of space, the height of the developing unit can be minimized, and the size of the main body of the image forming apparatus can be minimized.

While examples of a multi-path type image forming apparatus have been described above, it is noted again that these are just a few examples of the present general inventive concept. For example, the present general inventive concept applies to a single path type image forming apparatus.

As described above, in the developing unit and the image forming apparatus having the developing unit according to the above examples, a planar developer feeding plate reciprocally moves inside the developing unit to feed developer, thereby reducing the overload of the driving part and providing a simple configuration of the power transmission part.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. A developing unit, comprising:

a developer feeding unit which feeds developer;

a casing which supports the developer feeding unit and comprises a developer storing part provided in an area to face the developer feeding unit and to store the developer; and a developer feeding plate which is formed with at least one developer flowing hole into which the developer flows through, and is provided to move in a substantial straight direction between the developer storing part and the developer feeding unit within the casing.

2. The developing unit of claim 1, further comprising:

a feeding force transmitting part which is coupled to a driving part and applies a feeding force to the developer feeding plate to move the developer feeding plate between the developer storing part and the developer feeding unit.

3. The developing unit of claim 2, wherein the feeding force transmitting part comprises a crankshaft.

4. The developing unit of claim 3, wherein the crankshaft comprises a bending pressing part which is bent to extend away from the remainder of the crankshaft by a predetermined length.

5. The developing unit of claim 4, wherein a moving distance of the developer feeding plate corresponds to the predetermined length in which the bending pressing part extends away from the remainder of the crankshaft.

6. The developing unit of claim 4, wherein upper and lower walls of the casing are spaced apart a distance approximately twice as long as the predetermined length in which the bending pressing part extends away from the remainder of the crankshaft.

7. The developing unit of claim 4, wherein the developer feeding plate further comprises a pressing rib which is provided to contact with and be pressed by the bending pressing part to move the developer feeding plate between the developer feeding unit and the developer storing part when the crankshaft rotates.

8. The developing unit of claim 3, wherein the feeding force transmitting part comprises a pinion which is coupled to the driving part, and a rack which is connected to the developer feeding plate.

9. The developing unit of claim 2, further comprising:

a supplying part which is provided between the developer feeding unit and the developer feeding plate and to supply the developer fed by the developer feeding plate to the developer feeding unit.

10. The developing unit of claim 1, further comprising:

an elastic member which is provided between the casing and the developer feeding plate and applies an elastic force to the developer feeding plate to return the developer feeding plate the developer storing part.

11. The developing unit of claim 10, wherein a strength of an elasticity of the elastic member returns the developer feeding plate from the developer storing part to the developer feeding unit at a returning speed which is higher than a moving speed of the developer feeding plate from the developer feeding unit to the developer storing part.

12. The developing unit of claim 1, wherein the developer feeding plate comprises a plurality of plates.

13. The developing unit of claim 1, wherein the developer flowing hole has one of a rounded shape and a polygonal shape.

14. The developing unit of claim 13, wherein the developer flowing hole comprises a plurality of developer flow holes.

15. An image forming apparatus, comprising:

a paper feeding part to feed a printing medium;

a developing unit comprising a developer feeding unit which feeds developer, a casing which supports the developer feeding unit and comprises a developer storing part provided in an area to face the developer feeding unit and to store the developer, and a developer feeding plate which is formed with at least one developer flowing hole into which the developer flows through and is provided to move in a substantially straight direction between the developer storing part and the developer feeding unit within the casing;

an image receptor to spread the developer supplied from the developing unit on the printing medium;

an exposure part to expose the image receptor; and a transfer part to transfer the developer of the image receptor to the printing medium.

16. The image forming apparatus of claim 15, further comprising:

a driving part to generate a driving force; and a power transmission part to transmit the driving force of the driving part to the feeding force transmitting part.

17. A developing unit useable with an image forming apparatus, comprising:

a developer chamber to store developer;

a developer roller attached at an opening of the developer chamber to transmit the developer to an image receptor of the image forming apparatus; and a perforated plate formed with at least one developer flowing hole and movable in a substantial straight direction and positioned within the developer chamber to transmit developer to the developer roller.

18. The developing unit of claim 17, wherein the casing has a substantially flat bottom surface.

19. The developing unit of claim 17, wherein:

the developer chamber has an elongated block shape having a height, width and length respectively extending in directions which are perpendicular to each other;

the height of the developer chamber is smaller than its width and length; and the perforated plate extends in width and length directions of the developer chamber.

20. The developing unit of claim 17, wherein the perforated plate is mechanically coupled to a power transmission part to receive a force in a direction parallel to the plane of the perforated plate.

21. The developing unit of claim 17, further comprising:

a gear rotatably connected to the developer chamber to receive a rotating force; and a rotational shaft to receive the rotating force due to a mechanical connection with the gear, wherein the perforated plate receives a force from the rotational shaft which causes the perforated plate to reciprocally move along a bottom surface of the developer chamber.

22. The developing unit of claim 21, wherein:

the perforated plate receives the force from the rotational shaft which causes the perforated plate to move from a first position to a second position; and the developer chamber further comprises an elastic element connected to the perforated plate to restore the perforated plate to the first position from the second position.

23. The developing unit of claim 22, wherein the elasticity of the elastic element is of a magnitude to move the perforated plate from the first position to the second position at a speed which is greater than a speed at which the perforated plate moves from the first position to the second position by the force.

* * * * *